US009410513B2

(12) United States Patent
Sugiyama et al.

(10) Patent No.: US 9,410,513 B2
(45) Date of Patent: Aug. 9, 2016

(54) ENGINE CONFIGURED TO DRIVE A DIAPHRAGM FUEL PUMP USING PRESSURE FLUCTUATION IN A CRANK CHAMBER OF THE ENGINE

(75) Inventors: Masaki Sugiyama, Numazu (JP); Tetsuya Hasegawa, Numazu (JP)

(73) Assignee: MAKITA CORPORATION, Aichi (JP)

( * ) Notice: Subject to any disclaimer, the term of this patent is extended or adjusted under 35 U.S.C. 154(b) by 827 days.

(21) Appl. No.: 13/354,992

(22) Filed: Jan. 20, 2012

(65) Prior Publication Data

US 2012/0204840 A1 Aug. 16, 2012

(30) Foreign Application Priority Data

Feb. 14, 2011 (JP) ..... 2011-028702

(51) Int. Cl.

| | |
|---|---|
| ***F02M 37/04*** | (2006.01) |
| ***F02M 5/12*** | (2006.01) |
| ***F02M 37/14*** | (2006.01) |
| ***F02M 37/12*** | (2006.01) |

(52) U.S. Cl.

CPC ..... *F02M 37/046* (2013.01); *F02M 5/125* (2013.01); *F02M 37/12* (2013.01); *F02M 37/14* (2013.01)

(58) Field of Classification Search

CPC ..... F02M 37/046; F02M 37/12; F02M 37/14; F02M 17/04; F02M 59/14; F02M 5/125

USPC ..... 123/395, 495, 73 C, 509, 73 R–73 SP; 261/35, DIG. 68; 417/395

See application file for complete search history.

(56) References Cited

U.S. PATENT DOCUMENTS

| | | | | |
|---|---|---|---|---|
| 1,380,771 | A * | 6/1921 | Cartwright | 123/510 |
| 3,441,010 | A * | 4/1969 | Barr et al. | 123/445 |
| 3,453,994 | A * | 7/1969 | Nutten | F02B 75/16 123/73 R |
| 4,159,012 | A * | 6/1979 | Pizzuto | F02M 35/10196 123/65 R |
| 4,813,391 | A | 3/1989 | Geyer et al. | |
| 4,814,114 | A | 3/1989 | Charmley | |
| 4,936,267 | A | 6/1990 | Gerhardy et al. | |
| 5,048,477 | A | 9/1991 | Wada et al. | |
| 5,158,051 | A | 10/1992 | Wada et al. | |
| 5,165,371 | A | 11/1992 | Wada et al. | |
| 6,017,199 | A * | 1/2000 | Yanaka | 417/395 |

(Continued)

FOREIGN PATENT DOCUMENTS

| | | |
|---|---|---|
| DE | 38 23 525 A1 | 1/1990 |
| DE | 10 2008 058 498 A1 | 5/2010 |

(Continued)

OTHER PUBLICATIONS

141113 Kobayashi et al JP 2005106030 A english abstract JPO.*

(Continued)

*Primary Examiner* — Erick Solis
*Assistant Examiner* — Carl Staubach
(74) *Attorney, Agent, or Firm* — Oliff PLC

(57) ABSTRACT

An engine includes a crank chamber in which pressure fluctuation occurs and a carburetor including a diaphragm fuel pump. The diaphragm fuel pump includes a pump chamber configured to suck in and eject fuel and a diaphragm chamber to which a pressure that drives the pump chamber is supplied. The diaphragm chamber and the crank chamber communicate with one another in a state in which a negative pressure is created in the crank chamber.

9 Claims, 9 Drawing Sheets

(56) References Cited

U.S. PATENT DOCUMENTS

| | | | | |
|---|---|---|---|---|
| 6,494,180 | B1 | 12/2002 | Schlossarczyk | |
| 7,775,194 | B2 * | 8/2010 | Kono et al. | 123/517 |
| 2001/0005984 | A1 | 7/2001 | Knodler et al. | |
| 2010/0126475 | A1 | 5/2010 | Joos et al. | |
| 2014/0026857 | A1 * | 1/2014 | Tsutsui et al. | 123/447 |
| 2014/0026863 | A1 * | 1/2014 | Sumi et al. | 123/495 |

FOREIGN PATENT DOCUMENTS

| | | | | |
|---|---|---|---|---|
| JP | A-49-73528 | | 7/1974 | |
| JP | U1-57-10462 | | 1/1982 | |
| JP | U-60-188869 | | 12/1985 | |
| JP | A-64-12055 | | 1/1989 | |
| JP | A-64-73165 | | 3/1989 | |
| JP | A-2-45645 | | 2/1990 | |
| JP | A-3-189363 | | 8/1991 | |
| JP | A-7-293343 | | 11/1995 | |
| JP | A-9-158806 | | 6/1997 | |
| JP | A-2000-198489 | | 7/2000 | |
| JP | A-2001-99009 | | 4/2001 | |
| JP | A-2001-207914 | | 8/2001 | |
| JP | A-2003-172221 | | 6/2003 | |
| JP | 2005106030 | A * | 4/2005 | F04B 43/06 |
| JP | A-2005-140027 | | 6/2005 | |
| JP | A-2010-90846 | | 4/2010 | |

OTHER PUBLICATIONS

May 23, 2012 Extended European Search Report issued in European Patent Application No. 12154971.1.

Office Action issued in Japanese Patent Application No. 2011-028702 dated Jul. 29, 2014 (with translation).

* cited by examiner

ENGINE CONFIGURED TO DRIVE A DIAPHRAGM FUEL PUMP USING PRESSURE FLUCTUATION IN A CRANK CHAMBER OF THE ENGINE

CROSS-REFERENCE TO RELATED APPLICATION

This application is based upon and claims the benefit of priority from Japanese Patent Application No. 2011-028702, filed Feb. 14, 2011, the entire contents of which are incorporated herein by reference.

BACKGROUND

1. Field of the Invention

The present invention relates to an engine configured to drive a diaphragm fuel pump using the pressure fluctuation in a crank chamber of the engine.

2. Description of the Related Art

Recently, due to increasing public awareness regarding environmental issues, enhancement of emission control and so forth, a two-stroke engine has been taken over by a four-stroke engine, as a drive engine for a working machine such as a brush cutter, a chain saw and a backpack blower being carried by the user's hand or carried on the user's shoulder.

Some two-stroke engines use the pressure fluctuation in an intake port as a power source to drive a fuel pump (diaphragm fuel pump) as disclosed in, for example, Japanese Patent Application Laid-Open Publication No. 2005-140027 (Patent literature 1) and Japanese Patent Application Laid-Open Publication No. HEI9-158806 (Patent literature 2). However, most two-stroke engines use the pressure fluctuation in a crank chamber. In this case, a positive pressure and a negative pressure generated in the crank chamber are often used as a power source to drive a diaphragm chamber in a diaphragm fuel pump, as disclosed in, for example, Japanese Patent Application Laid-Open Publication No. 11E13-189363 (Patent literature 3), Japanese Patent Application Laid-Open Publication No. 2003-172221 (Patent literature 4) and Japanese Patent Application Laid-Open Publication No. 2001-207914 (Patent literature 5).

In the cases of Patent literature 1 and patent literature 2, that is, if a diaphragm fuel pump in a four-stroke engine is driven by using the pressure fluctuation in an intake port as a power source, there is a problem that the diaphragm fuel pump cannot acquire sufficient power because the pressure in the intake port changes only once while a crankshaft rotates twice. In addition, in the cases of Patent literature 3, Patent literature 4 and Patent literature 5, that is, if a diaphragm fuel pump is driven by using the pressure fluctuation in a crank chamber, it is possible to acquire power by which the pressure changes once while a crankshaft rotates once, and consequently solve the above-described problem. However, a positive pressure in the crank chamber affects the inside of a diaphragm chamber, and therefore the oil from the crank chamber enters the diaphragm chamber and a path in communication with the diaphragm chamber. As a result, the pressure fluctuation cannot be transferred to the diaphragm chamber, and this may cause eventually the diaphragm fuel pump failure.

SUMMARY

The present invention was achieved in view of the above-described background. It is therefore an object of the present invention to provide an engine configured to be able to acquire sufficient pressure fluctuation to drive a diaphragm fuel pump and prevent oil from entering a diaphragm chamber.

To solve the above-described problem, an engine includes: a crank chamber in which pressure fluctuation occurs; and a carburetor including a diaphragm fuel pump. The diaphragm fuel pump includes a pump chamber configured to suck in and eject fuel; and a diaphragm chamber to which a pressure that drives the pump chamber is supplied. The diaphragm chamber and the crank chamber communicate with one another in a state in which a negative pressure is created in the crank chamber.

It is preferred that the engine further includes a communicating path configured to allow communication between the diaphragm chamber and the crank chamber. An atmospheric pressure opening path configured to communicate with a space under atmospheric pressure is connected to the communicating path.

It is preferred that the engine further includes a communicating path configured to allow communication between the diaphragm chamber and the crank chamber. An atmospheric pressure opening path configured to communicate with a space under atmospheric pressure is connected to the diaphragm chamber.

It is preferred that the engine further includes a communicating path configured to allow communication between the diaphragm chamber and the crank chamber. An opening of the communicating path in the crank chamber side is formed near a position in which a termination portion of a skirt part in a piston is located when the piston is located at a top dead center.

It is preferred that the engine further includes a communicating path configured to allow communication between the diaphragm chamber and the crank chamber. An opening of the communicating path in the crank chamber side is formed in a position closer to a crankshaft than a position in which a piston ring is located when the piston is located at a bottom dead center.

It is preferred that the opening of the communicating path in the crank chamber side is formed in a position near the position in which the piston ring of the piston is located when the piston is located at the bottom dead center.

It is preferred that the engine further includes a communicating path configured to allow communication between the diaphragm chamber and the crank chamber. An orifice is formed in an opening of the communicating path in the crank chamber side.

It is preferred that the engine further includes a communicating path configured to allow communication between the diaphragm chamber and the crank chamber. An orifice is formed in an atmospheric pressure opening path, the atmospheric pressure opening path being connected to one of the communicating path and the diaphragm chamber to allow communication with a space under atmospheric pressure.

It is preferred that the engine further includes a communicating path configured to allow communication between the diaphragm chamber and the crank chamber. An orifice is formed in an atmospheric pressure opening path, the atmospheric pressure opening path being connected to one of the communicating path and the diaphragm chamber to allow communication with a space under atmospheric pressure.

It is preferred that the engine is a four-stroke engine.

According to the present invention, it is possible to provide an engine configured to be able to acquire sufficient pressure fluctuation to drive a diaphragm fuel pump and prevent oil from entering a diaphragm chamber.

DETAILED DESCRIPTION

<Embodiment 1>

Figure 1:
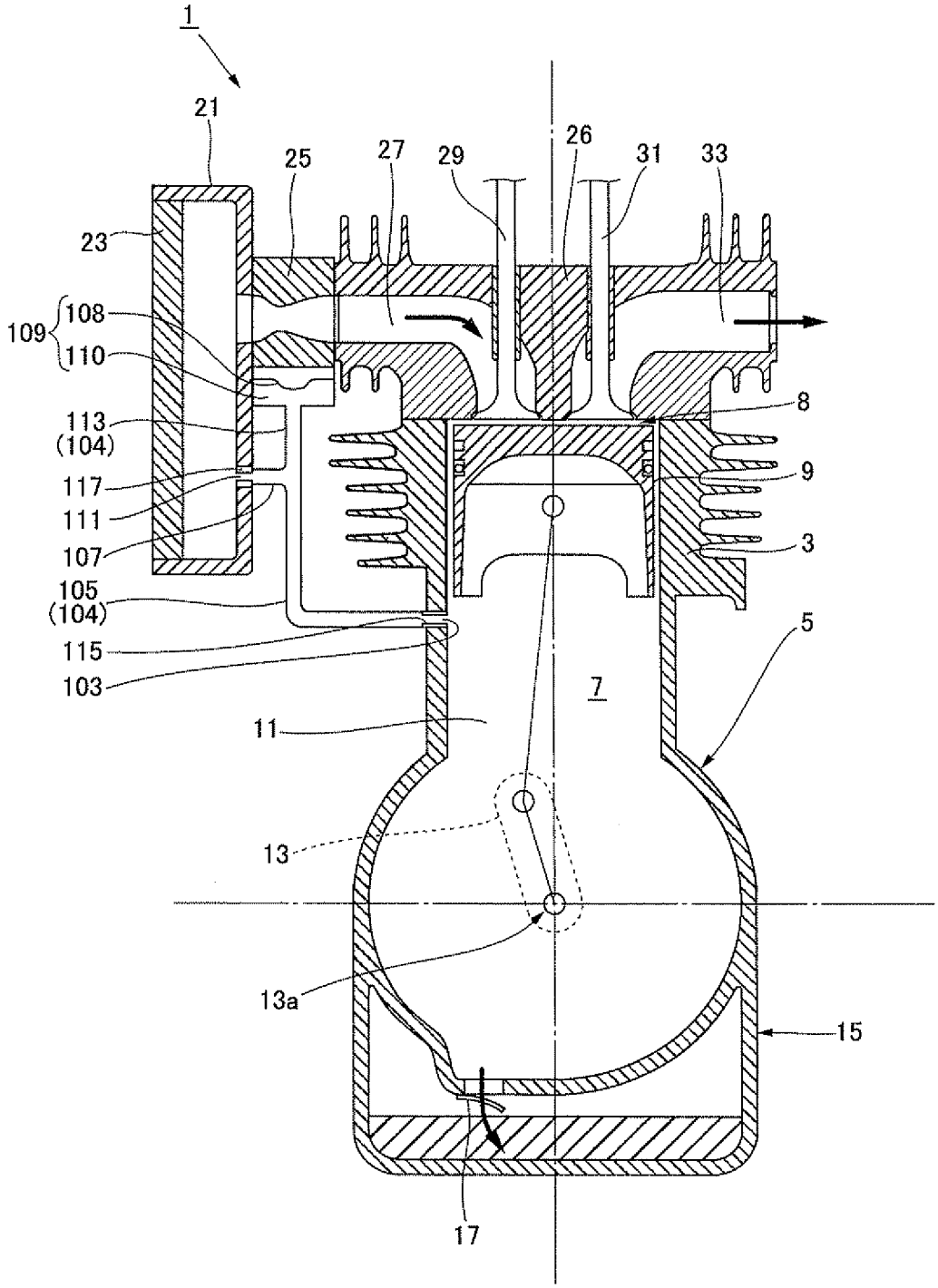
FIG. 1 is an illustration schematically showing Embodiment 1 of the present invention.

Now, preferred Embodiment 1 of an engine according to the present invention will be explained with reference to FIG. 1. FIG. 1 is an illustration schematically showing Embodiment 1 of the present invention. Here, a four-stroke engine 1 is shown in FIG. 1 where a piston is located near the top dead center (TDC).

As shown in FIG. 1, the four-stroke engine 1 includes a cylinder part 3, a crank case 5 mounted under the cylinder part 3 and an oil tank 15 provided below the crank case 5. The cylinder part 3 has a cylindrical space to slidably move a piston 9 upward and downward in FIG. 1. Then, the piston 9 is fitted into the space with a gap to slidably move upward and downward in FIG. 1. A crank chamber 7 is defined by the cylinder part 3, the crank case 5 and the piston 9. That is, the crank chamber 7 is an approximately cylindrical space defined by the side surface of the cylinder part 3, the piston 9 and the crank case 5. The volume of the inner space of this crank chamber 7 varies as the piston 9 slidably moves. A combustion chamber 8 is defined by the cylinder head 26, the cylinder part 3 and the piston 9. The oil tank 15 to store oil is provided separately from the crank case 5.

A check valve 17 is provided between the oil tank 15 and the crank case 5 to allow oil to flow only in the direction from the crank case 5 (crank chamber 7) to the oil tank 15. Here, a negative pressure is created in the crank chamber 7 as the piston 9 moves from the bottom dead center (BDC) to TDC. By contrast with this, a positive pressure is created in the crank chamber 7 as the piston 9 moves from TDC to BDC. Although a negative pressure is easily created in the crank chamber 7 because the check valve 17 is provided, the pressure in the crank chamber 7 can rise only up to a positive pressure that overcomes the elasticity of a spring and so forth used in the check valve 17. Then, the elasticity of a spring and so forth used in the check valve 17 is relatively poor, so that the pressure in the crank chamber can only increase to a positive pressure a little. Here, the pressure in the crank chamber 7 changes once while a crankshaft 13*a* rotates once. This is different from the pressure in an intake port or an exhaust port, which changes only once while the crankshaft 13*a* rotates twice.

A crank 13 is rotatably supported in the crank case 5. This crank 13 is formed by the crankshaft 13*a* which is the center of rotation, counterweight and so forth. The piston 9 and the crank 13 are connected one another via a connecting rod 11. The connecting rod 11 is rotatably connected to both the piston 9 and the crank 13. This configuration allows the piston 9 to reciprocally and slidably move in the cylinder part 3.

A cylinder head 26 is provided on the upper wall of the cylinder part 3. The cylinder head 26 is provided with an intake port 27 that allows communication with the carburetor 25 and an exhaust port 33 that allows communication with an exhaust muffler (not shown). The cylinder head 26 is also provided with an intake valve 29 to open and close the intake port 27. In addition, the cylinder head 26 is provided with an exhaust valve 31 to open and close the exhaust port 33.

An air cleaner 21 is provided outside the carburetor 25. A filter 23 is disposed in the air cleaner 21. The filter 23 allows air to pass through to remove dust and so forth in the air.

The carburetor 25 is an apparatus to mix fuel into the air having passed through the air cleaner 21. To be more specific, the carburetor 25 can control mixing of the air and fuel and also control the total amount of the air-fuel mixture. The carburetor 25 has a diaphragm fuel pump 109 to mix fuel into the air. This diaphragm fuel pump 109 is driven using pressure fluctuation as power.

With the present embodiment, a diaphragm chamber 110 in the diaphragm fuel pump 109 is connected to the crank chamber 7 via a communicating path 104 to supply power. Here, the diaphragm fuel pump 109 is provided with a diaphragm 108 whose position changes in response to pressure fluctuation.

A crank chamber side opening 103 is provided in the communicating path 104 in the crank chamber 7 side. Then, an atmospheric pressure opening path 107 is connected to the communicating path 104. One end of the atmospheric pressure opening path 107 has an air cleaner side opening 117 which opens in the air cleaner 21 (the space after the air has passed through the filter 23). The other end of the atmospheric pressure opening path 107 opens on the way of the route of the communicating path 104. Here, with respect to the connecting point between the communicating path 104 and the atmospheric pressure opening path 107, the communicating path 104 in the diaphragm chamber 110 side is referred to as a diaphragm chamber side communicating path 113, and the communicating path 104 in the crank chamber 7 side is referred to as a crank chamber side communicating path 105.

By providing the atmospheric pressure opening path 107, even if oil and so forth enters the communication path 104, it is possible to eject the oil and so forth to the crank chamber 7 when a negative pressure is created in the crank chamber 7. It is because the air cleaner side opening 117 in the atmospheric pressure opening path 107 opens in a space under atmospheric pressure. Therefore, when a negative pressure is created in the crank chamber 7, the air enters the crank chamber side opening 103 from the air cleaner side opening 117 to eject the oil having flown into the communicating path 104. Here, note that the pipeline resistance of the atmospheric pressure opening path 107 should not be set too low in order to prevent the performance of the diaphragm fuel pump 109 from degrading. It is because too low pipeline resistance of the atmospheric pressure opening path 107 causes a situation in which the air not in the diaphragm chamber 110 side but in the atmospheric pressure opening path 107 side is sucked too much when a negative pressure is created in the crank chamber 7.

An air cleaner side orifice 111 is provided to set the pipeline resistance of the atmospheric pressure opening path 107. This air cleaner side orifice 111 increases pipeline resistance. In order to increase pipeline resistance, there are several methods, for example, a method of setting the length of a pipeline long, a method of setting the entire pipeline thin, a method of folding a pipeline more than once and so forth. Here, combinations of the above-described methods are possible to provide a synergistic effect. In addition, the air cleaner side orifice 111 does not need to be always provided near the air cleaner side opening 117 because it is used to set pipeline resistance. For example, the air cleaner side orifice 111 may be provided in the center of the atmospheric pressure opening path 107, the communicating path 104 side and so forth.

A crank chamber side orifice 115 is provided in the crank chamber side opening 103. This crank chamber side orifice 115 serves to control pressure fluctuation to drive the diaphragm fuel pump 109. In addition, the crank chamber side orifice 115 is provided to reduce the amount of oil and so forth flowing from the crank chamber 7 into the communicating path 104.

The atmospheric pressure opening path 107 opens in the space (the cleaned side) after the air has passed through the filter 23 in the air cleaner 21. Therefore, it is possible to flow the cleaned air not containing dust and so forth into the atmospheric pressure opening path 107.

Figure 2:
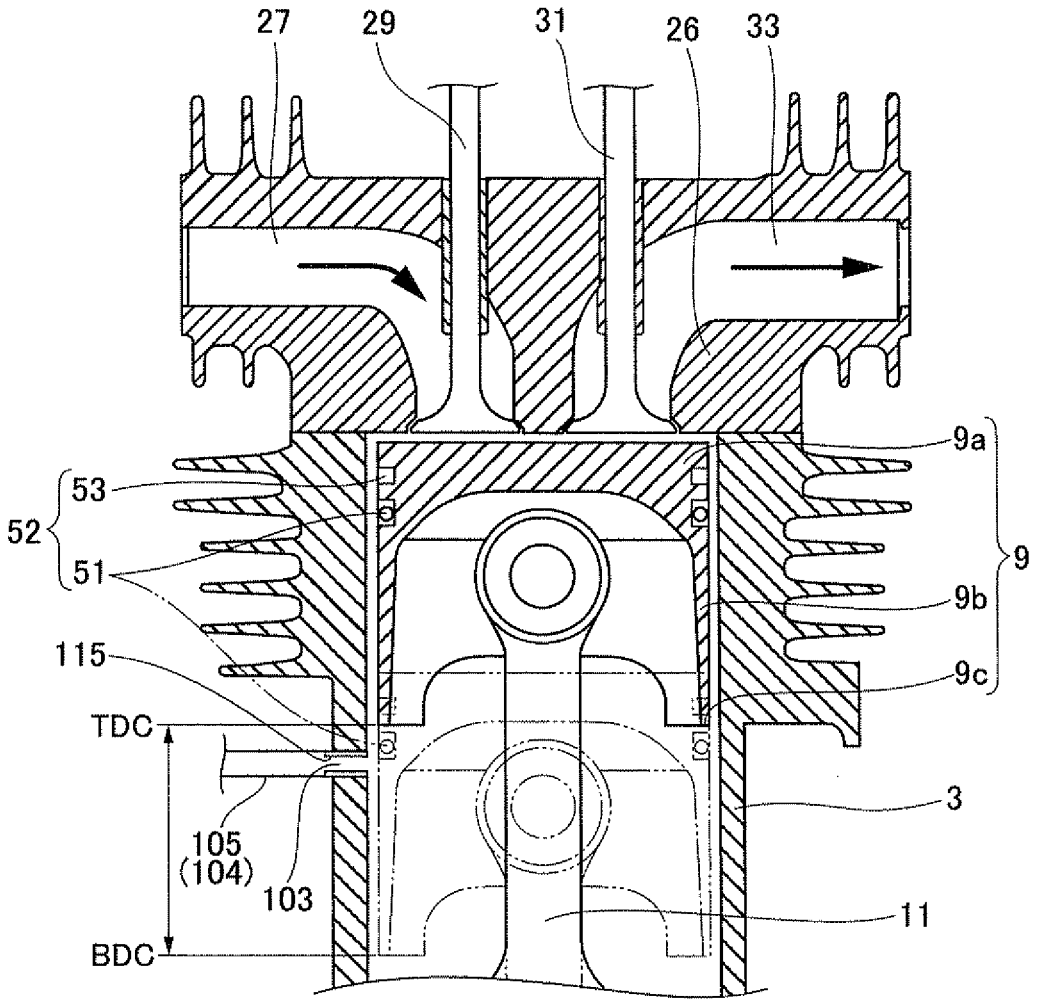
FIG. 2 is an illustration showing the position of a crank chamber side opening.

FIG. 2 is an illustration showing the position of the crank chamber side opening 103. Here, in FIG. 2, the piston 9 located at TDC is indicated by the solid line, and the piston 9 located at BDC is indicated by the broken line.

Here, piston 9 includes a piston head 9*a* and a skirt part 9*b* following the piston head 9*a*. A termination portion 9*c* is formed at the end of the skirt part 9*b* in the crank chamber 7 side.

With the present embodiment, as shown in FIG. 2, the crank chamber side opening 103 of the communicating path 104 in the crank chamber 7 side is formed to open in the position near the position where the termination portion 9*c* of the skirt part 9*b* in the piston 9 is located when the piston 9 is located at TDC. This prevents oil and so forth from entering the communicating path 104 and the diaphragm chamber 110 due to a positive pressure created in the crank chamber 7 (crank case 5). Moreover, the crank chamber side opening 103 of the communicating path 104 in the crank chamber 7 side is formed to open in the position closer to the crankshaft 13*a* than the position in which the termination portion 9*c* is located when the piston 9 is located at TDC. By forming the crank chamber side opening 103 in this position, it is possible to close the communicating path 104 when a positive pressure is created in the crank chamber 7, and consequently supply substantially only a negative pressure to the communicating path 104.

An annular piston ring 52 is fitted into a portion of the side surface of the piston 9 in the combustion chamber 8 side. This piston ring 52 is formed by a compression ring 53 and an oil ring 51. The compression ring 53 needs to always be tightly attached to the cylinder part 3 because it is provided to separate the combustion chamber 8 from the crank chamber 7. In addition, the compression ring 53 needs to lubricate to prevent abrasion because it slidably moves. Therefore, there is much more oil in the gap portion between the cylinder part 3 and the piston 9 in the combustion chamber 8 side than in the region between the compression ring 53 and the oil ring 51. There is blowby gas and so forth in the gap portion. Therefore, when the piston 9 moves to place the crank chamber side opening 103 between the compression ring 53 and the oil ring 51, oil, blowby gas and so forth may enter the communicating path 104 from the crank chamber side opening 103. As the present embodiment, the crank chamber side opening 103 of the communicating path 104 in the crank chamber 7 side is formed in the position closer to the crankshaft 13*a* than the position in which the oil ring 51 is located when the piston 9 is located at BDC. This prevents oil and so forth from entering the communicating path 104 from the crank chamber side opening 103.

If the crank chamber side opening 103 is formed in the position apart from the position in which the oil ring 51 in the piston 9 is located when the piston 9 is located at BDC, it is required to increase the length of the skirt part 9*b* accordingly, and consequently increase the size of the piston 9. Therefore, with the present embodiment, the crank chamber side opening 103 is formed near the position in which the oil ring 51 in the piston 9 is located when the piston 9 is located at BDC to reduce the size of the piston 9 and prevent oil and so forth from entering the communicating path 104.

Here, with the present embodiment, the crank chamber side opening 103 is formed in the position near the position in which the termination portion 9*c* of the skirt part 9*b* in the piston 9 is located when the piston 9 is located at TDC as shown in FIG. 2. In this case, even if a negative pressure is applied to the communicating path 104, the diaphragm fuel pump 109 cannot exhibit sufficient performance unless there is the atmospheric pressure opening path 107. It is because the crank chamber side opening 103 is closed by the skirt part 9*b* before the pressure returns to a positive pressure after the piston 9 has arrived at TDC and the pressure in the communicating path 104 has been minimized. This causes a situation in which the pressure in the communicating path 104 keeps a certain negative pressure, and therefore it is not possible to generate sufficient pressure fluctuation. Then, when the piston 9 arrives at TDC by the next stroke, the pressure can only change from the certain negative pressure to the minimum pressure. The diaphragm fuel pump 109 is driven according to the magnitude of pressure fluctuation, and therefore cannot work if the magnitude of pressure fluctuation is small. Therefore, with the present embodiment, a configuration is adopted where the atmospheric pressure opening path 107 is provided and the air is supplied to the communicating path 104 while the crank chamber side opening 103 is closed by the skirt part 9*b* in the piston 9 to make the pressure fluctuation in the diaphragm chamber 110 greater. Here, with the configuration according to the present embodiment, the period of time over which the crank chamber side opening 103 is closed is substantially longer than the period of time over which the crank chamber side opening 103 is open. Therefore, even if the pipeline resistance of the atmospheric pressure opening path 107 increases to some extent, it is possible to supply a sufficient amount of the air to the communicating path 104. By this means, it is possible to generate a sufficient magnitude of pressure fluctuation in the communicating path 104.

Figure 3:
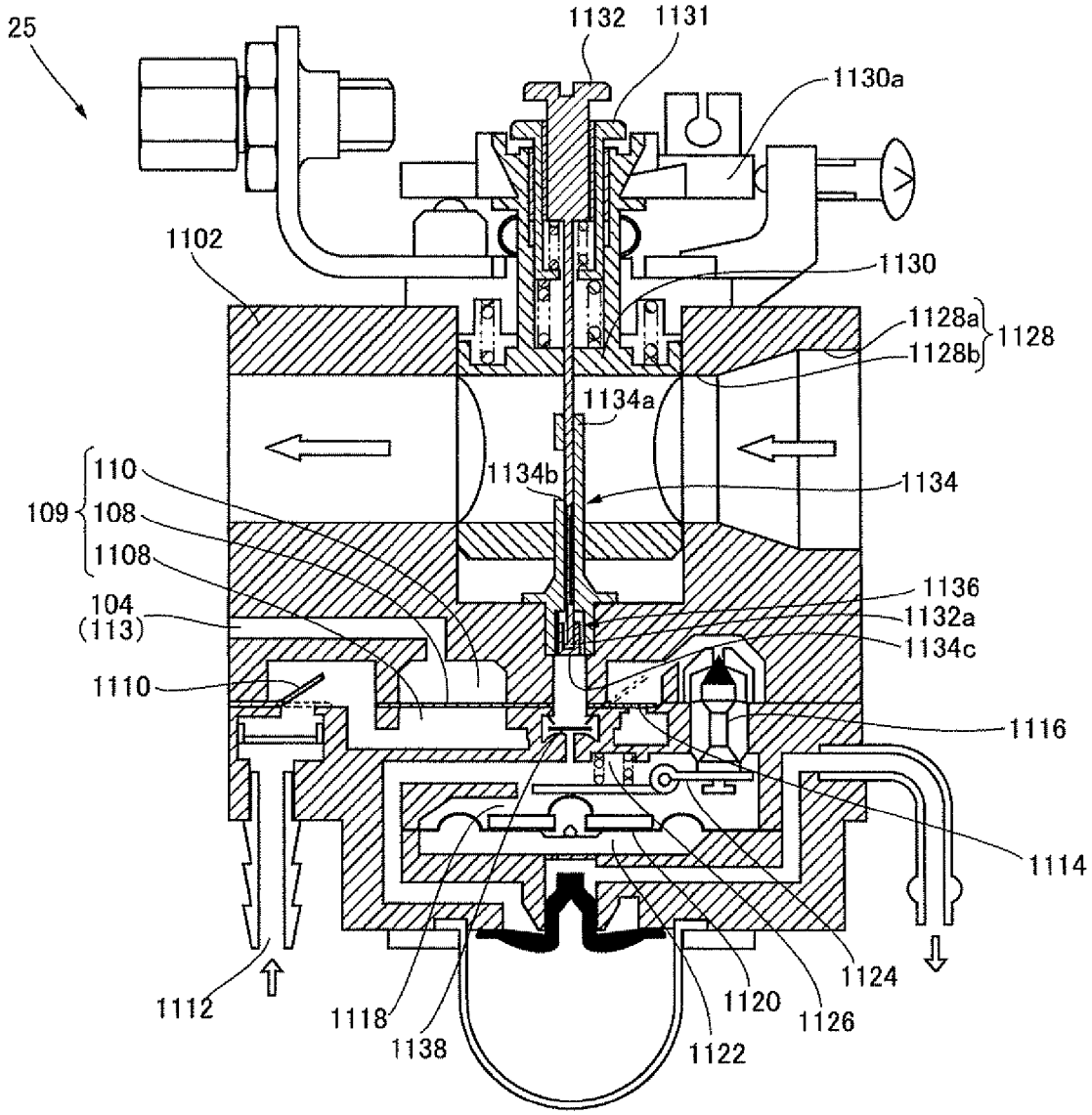
FIG. 3 is an illustration showing the structure of a carburetor using a diaphragm fuel pump.

FIG. 3 is an illustration showing the structure of the carburetor 25 using the diaphragm fuel pump 109.

As shown in FIG. 3, the carburetor 25 includes a carburetor body 1102. The communicating path 104 which allows communication with the crank chamber 7, is formed in the carburetor body 1102. This communicating path 104 faces the diaphragm chamber 110, which is one side (the upper part in the figure) of the diaphragm fuel pump 109. A pump chamber 1108 is formed in the other side (the lower part in the figure) of the diaphragm fuel pump 109. A fuel inlet 1112 communicates with the pump chamber 1108 via an inlet valve 1110, and a metering chamber 118 in a metering diaphragm 1120 communicates with the pump chamber 1108 via an outlet valve 1114 and a needle valve 1116. Here, the fuel inlet 1112 is connected to a fuel tank (not shown). The crank chamber side opening 103 of the communicating path 104 in the crank chamber 7 side is formed in the cylinder part 3 which defines the crank chamber 7.

The pressure in the crank chamber 7 varies according to a change in its volume. As described above, only a negative pressure of the varying pressure affects the diaphragm chamber 110 via the communicating path 104. Then, the diaphragm fuel pump 109 is driven by the negative pressure affecting the diaphragm chamber 110. To be more specific, a negative pressure affects the diaphragm chamber 110 in the diaphragm fuel pump 109, and therefore the negative pressure affects the pump chamber 1108 side when the diaphragm 108 bends to the diaphragm chamber 110 side. The negative pressure in the pump chamber 1108 allows the inlet valve 1110 to open while the outlet valve 1114 is closed, and therefore fuel is sucked from the fuel inlet 1112 into the pump chamber 1108. Next, in this state, when the negative pressure affecting the diaphragm chamber 110 in the diaphragm fuel pump 109 changes to a positive pressure, the elastic force of the diaphragm 108 forces the diaphragm 108 to return to the original state. Therefore, a positive pressure affects the pump chamber 1108 side. Then, when the motion of the diaphragm 108 causes the positive pressure to affect the pump chamber 1108 side, the outlet valve 1114 opens while the inlet valve 1110 remains closed to eject the fuel from the pump chamber 1108. This ejected fuel is supplied to the metering chamber 1118 in the metering diaphragm 1120 via the needle valve 1116.

The metering chamber 1118 is separated from a back pressure chamber 1122 by the metering diaphragm 1120. The pressure of the four-stroke engine 1 affects the back pressure chamber 1122. The metering diaphragm 1120 is driven by the difference in pressure between the four-stroke engine 1 and the metering chamber 1118. Here, a path is not shown in the figure, which allows communication between the back pressure chamber 1122 and the space under a negative pressure in the engine. The metering diaphragm 1120 is connected to the above-described needle valve 1116 via a control lever 1124, and operates to open and close the needle valve 1116. To be more specific, when the metering chamber 1118 is filled with fuel, the pressure in the metering chamber 1118 rises and the metering diaphragm 1120 bends to the back pressure chamber 1122 side. At this time, the elastic force of a control lever spring 1126 causes the control lever 1124 to rotate such that one end (the left side in the figure) of the control lever 1124 is pushed down and the other end (the right side in the figure) is pushed up. This rotation of the control lever 1124 causes the needle valve 1116 to push up and breaks the communication between the pump chamber 1108 and the metering chamber 1118.

A path 1128 is formed in the carburetor body 1102 to connect between the intake port 27 formed in the cylinder part 3 and the air cleaner 21. This path 1128 has a large diameter part 1128*a* in the upper stream side (the air cleaner 21 side) and a smaller venturi part 1128*b* in the downstream side (the intake port 27 side) than the large diameter part 1128*a*. The venturi part 1128*b* includes a throttle valve 1130 to change its opening. The axis of rotation of the throttle valve 1130 is orthogonal to the path 1128. By operating a rotating lever 1130*a*, the throttle valve 1130 rotates, sliding upward and downward in the figure to change the opening of the venturi part 1128*b* according to the degree of rotation.

In addition, this throttle valve 1130 is provided with a first adjuster screw 1131 which is coaxial with the axis of rotation of the throttle valve 1130 to fine-tune the amount of fuel mixed into the air flowing through the path 1128. This first adjuster screw 1131 is provided with a second adjuster screw 1132 which is coaxial with the axis of rotation of the first adjuster screw 1131. The second adjuster screw 1132 is provided to extend upward and downward in the figure. The outer diameter of the second adjuster screw 1132, which is approximately the same as the inner diameter of the nozzle 1134 described later, reduces from the top to the bottom in two steps. A switching part 1132*a* to switch a main jet 1136 described later is provided on the tip of the second adjuster screw 1132. In the figure, the first adjuster screw 1131 moves downward, rotating in one direction (to tighten the screw) with respect to the throttle valve 1130, and, on the other hand, moves upward, rotating in the other direction (to loosen the screw) with respect to the throttle valve 1130. Likewise, in the figure, the second adjuster screw 1132 moves downward, rotating in one direction (to tighten the screw) with respect to the first adjuster screw 1131, and, on the other hand, moves upward, rotating in the other direction (to loosen the screw) with respect to the first adjuster screw 1131.

The nozzle 1134 is provided in the carburetor body 1102 to face the second adjuster screw 1132. The tip of the second adjuster screw 1132 is inserted into a nozzle tip 1134*a* of the nozzle 1134. In addition, the nozzle 1134 includes a hole 1134*b* which opens in the path 1128. A bottom 1134*c* in communication with the hole 1134*b* faces the metering chamber 1118. Here, the main jet 1136 and a main check valve 1138, which serve as a mixture ratio adjusting means and a fuel adjusting mechanism, are provided between the hole 1134*b* and the metering chamber 1118.

Figure 4:
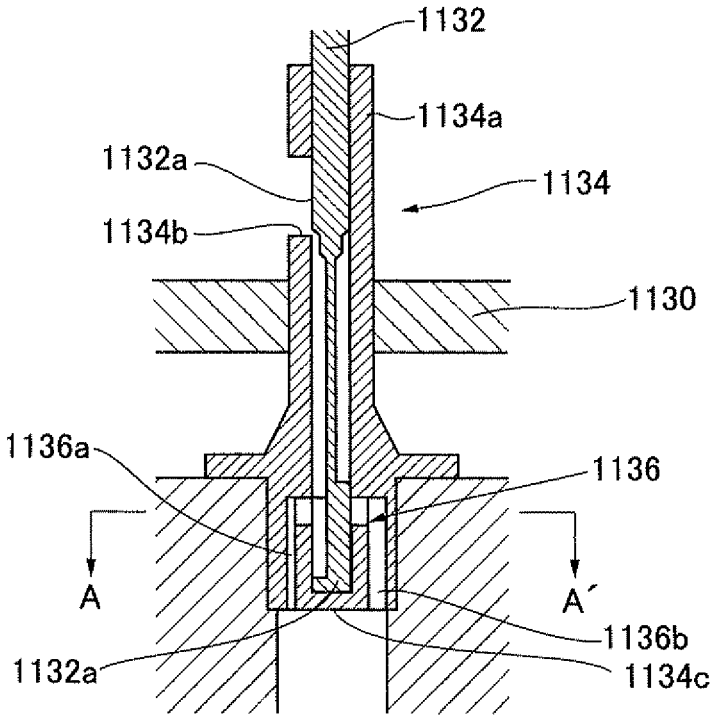
FIG. 4 is an illustration showing a nozzle.

FIG. 4 is an illustration showing the nozzle 1134. Here, FIG. 5 is a cross sectional view taken along line A-A' of FIG. 4.

Figure 5:
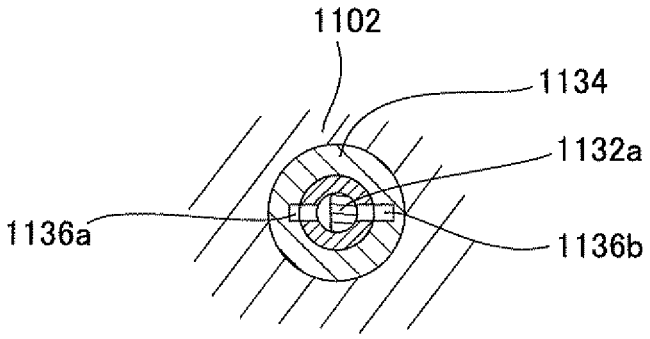
FIG. 5 is a cross sectional view taken along line A-A' of FIG. 4.

As shown in FIG. 4 and FIG. 5, the main jet 1136 includes a first main jet part 1136*a* and a second main jet part 1136*b*. The first main jet part 1136*a* has a predetermined opening area to allow communication between the hole 1134*b* of the nozzle 1134 and the metering chamber 1118. The second main jet part 1136*b* has a larger opening area than of the first main jet part 1136*a* to allow communication between the hole 1134*b* of the nozzle 1134 and the metering chamber 1118. One of the first main jet part 1136*a* and the second main jet part 1136*b* of the main jet 1136 is closed by the switching part 1132*a* in the second adjuster screw 1132, and the other allows communication between the hole 1134*b* of the nozzle 1134 and the metering chamber 1118. By rotating the second adjuster screw 1132 with respect to the first adjuster screw 1131, it is possible to switch between open and close of the first main jet part 1136*a* and the second main jet part 1136*b* of the main jet 1136. That is, by rotating the second adjuster screw 1132 with respect to the first adjuster screw 1131 according to fuel to be used, it is possible to deliver fuel to one of the first main jet part 1136*a* and the second main jet part 1136*b* of the main jet 1136.

Figure 6:
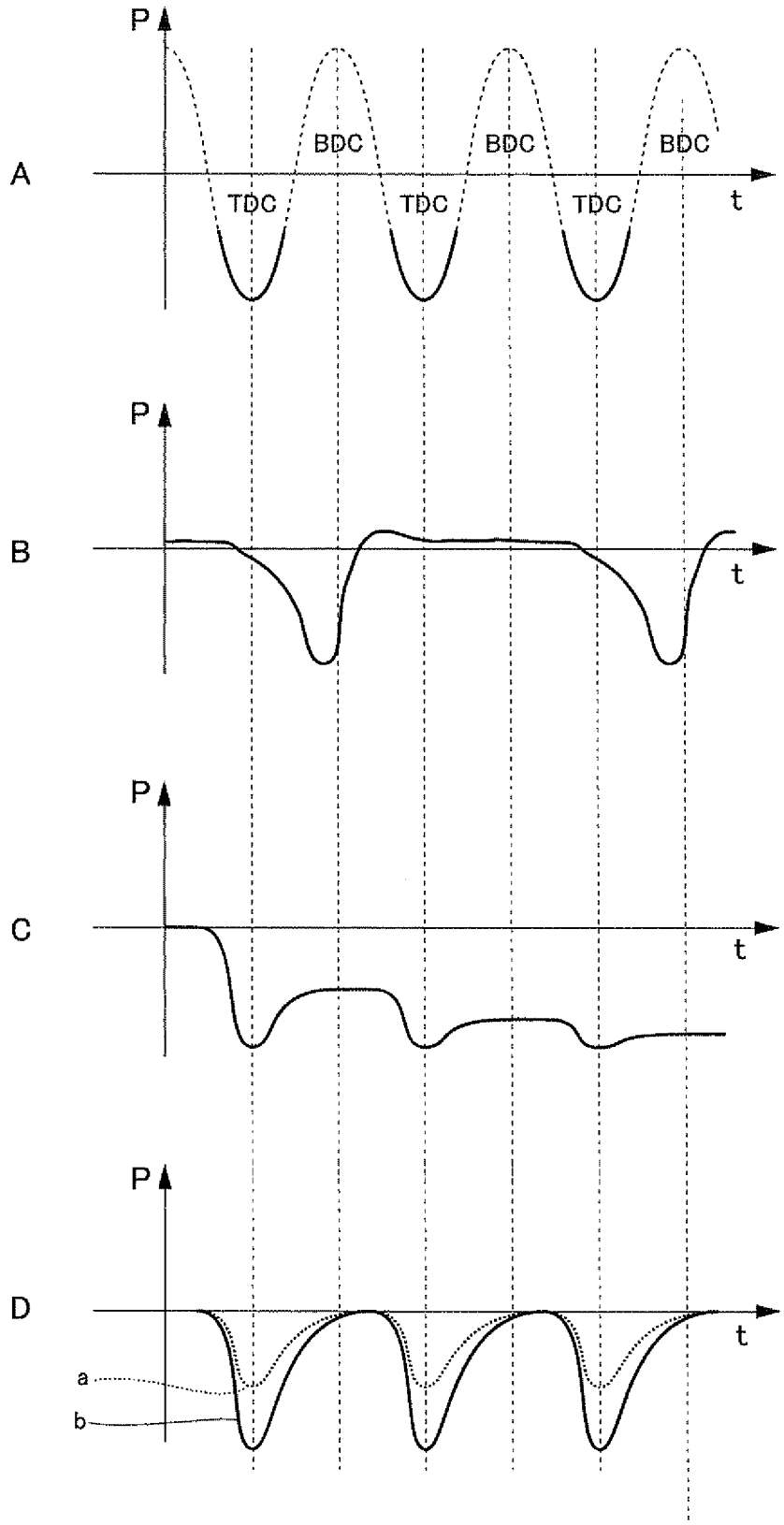
FIG. 6 is an illustration showing an effect of Embodiment 1.

FIG. 6 is an illustration showing an effect of the present embodiment.

As the piston 9 reciprocates between TDC and BDC, the pressure in the crank chamber 7 fluctuates as shown in the solid line and the broken line in FIG. 6A. On the other hand, the pressure in the intake port 27 changes only once while the crankshaft 13*a* rotates twice as shown in FIG. 6B. Therefore, it is not appropriate to use the pressure in the intake port 27 as the power source for the diaphragm fuel pump 109. As the configuration with the present embodiment, the crank chamber side opening 103 of the communicating path 104 in the crank chamber 7 side is formed to open in the position near the position in which the termination portion 9*c* of the skirt part 9*b* in the piston 9 is located when the piston 9 is located at TDC. By this means, the pressure in the crank chamber 7 acts near the crank chamber side opening 103 as shown in the solid line in FIG. 6A. However, in this configuration, if there is no atmospheric pressure opening path 107, the pressure in the communicating path 104 can only fluctuate as shown in FIG. 6C. Under such a circumstance, the diaphragm fuel pump 109 cannot work satisfactorily because it is driven according to the magnitude of pressure fluctuation. Therefore, the atmospheric pressure opening path 107 is connected to the communicating path 104 to allow the air in the space under atmospheric pressure to be supplied to the communicating path 104. By this means, the pressure in the communicating path 104 is returned to nearly atmospheric pressure, so that it is possible to make pressure fluctuation greater as shown in FIG. 6D. Here, broken line a shown in FIG. 6D shows the pressure fluctuation in a case in which the air cleaner side orifice 111 is not provided in the air cleaner side opening 117 of the atmospheric pressure opening path 107. Meanwhile, solid line b shown in FIG. 6D shows the pressure fluctuation in a case in which the air cleaner side orifice 111 is provided in the air cleaner side opening 117 of the atmospheric pressure opening path 107. As described above, by providing the air cleaner side orifice 111, it is possible to adequately increase the pipeline resistance of the atmospheric opening path 107 to prevent the air from being sucked more than necessary from the atmospheric pressure opening path 107 when the crank chamber 7 and the communicating path 104 communicate with one another. Here, the air cleaner side orifice 111 is not always required, but a case is possible where the pipeline is thinned, lengthened, bent and the like to control pipeline resistance. However, with the above-described methods, it is not easy to control pipeline resistance. Therefore, it is preferable to provide the air cleaner side orifice 111.

Moreover, by providing the atmospheric pressure opening path 107, it is possible to eject oil and so forth having entered the communicating path 104 by an ejector effect. Here, for this, it is preferable to increase a speed at which the airflows from the atmospheric pressure opening path 107 to the communicating path 104.

<Embodiment 2>

Figure 7:
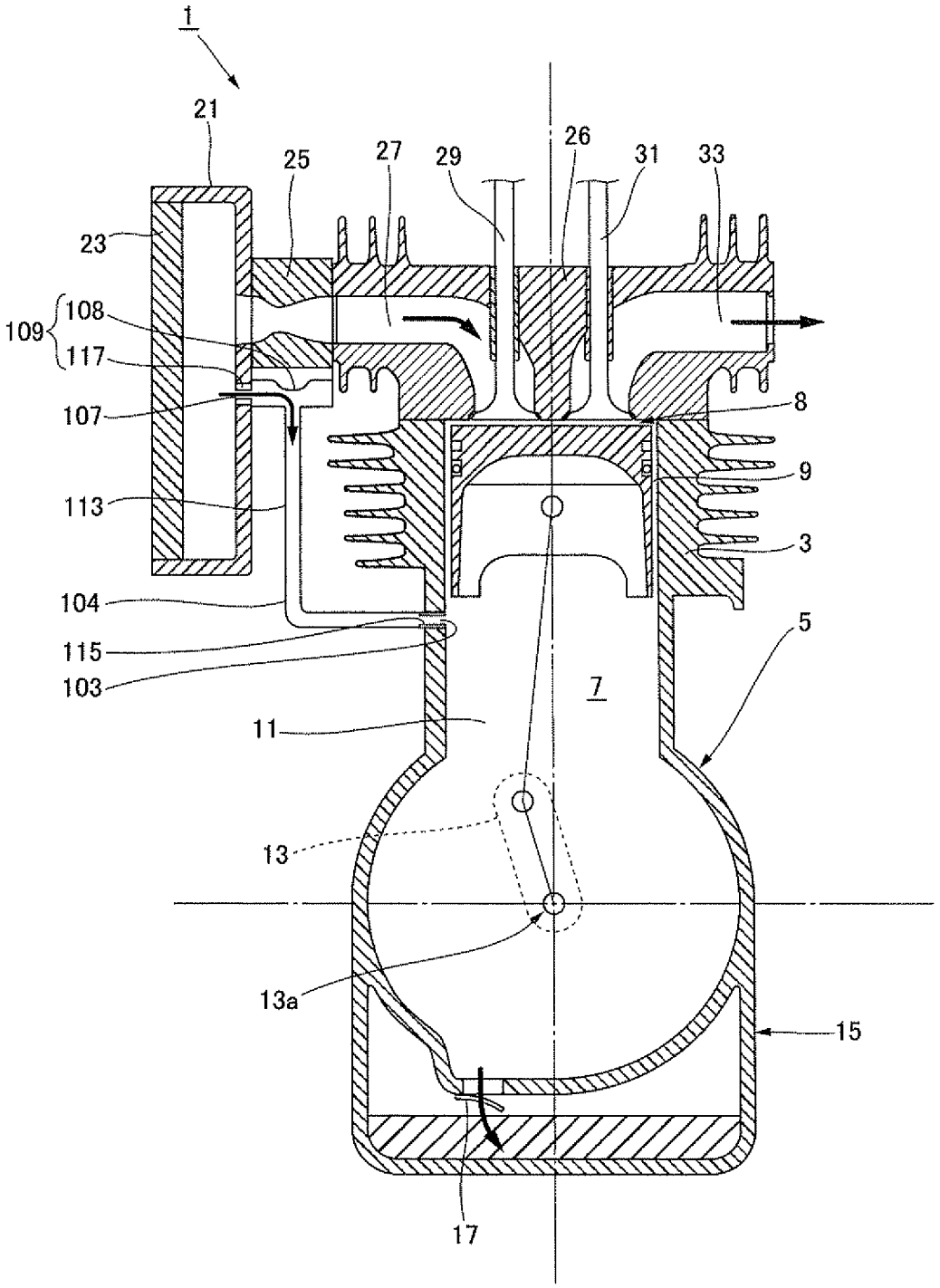
FIG. 7 is an illustration showing Embodiment 2.

FIG. 7 is an illustration showing Embodiment 2.

The atmospheric pressure opening path 107 does not communicate with the communicating path 104 but communicates with the diaphragm chamber 110 in the diaphragm fuel pump 109. Here, in this case, it is preferable to provide the air cleaner side orifice 111 in the air cleaner side opening 117 of the atmospheric pressure opening path 107.

<Embodiment 3>

Figure 8:
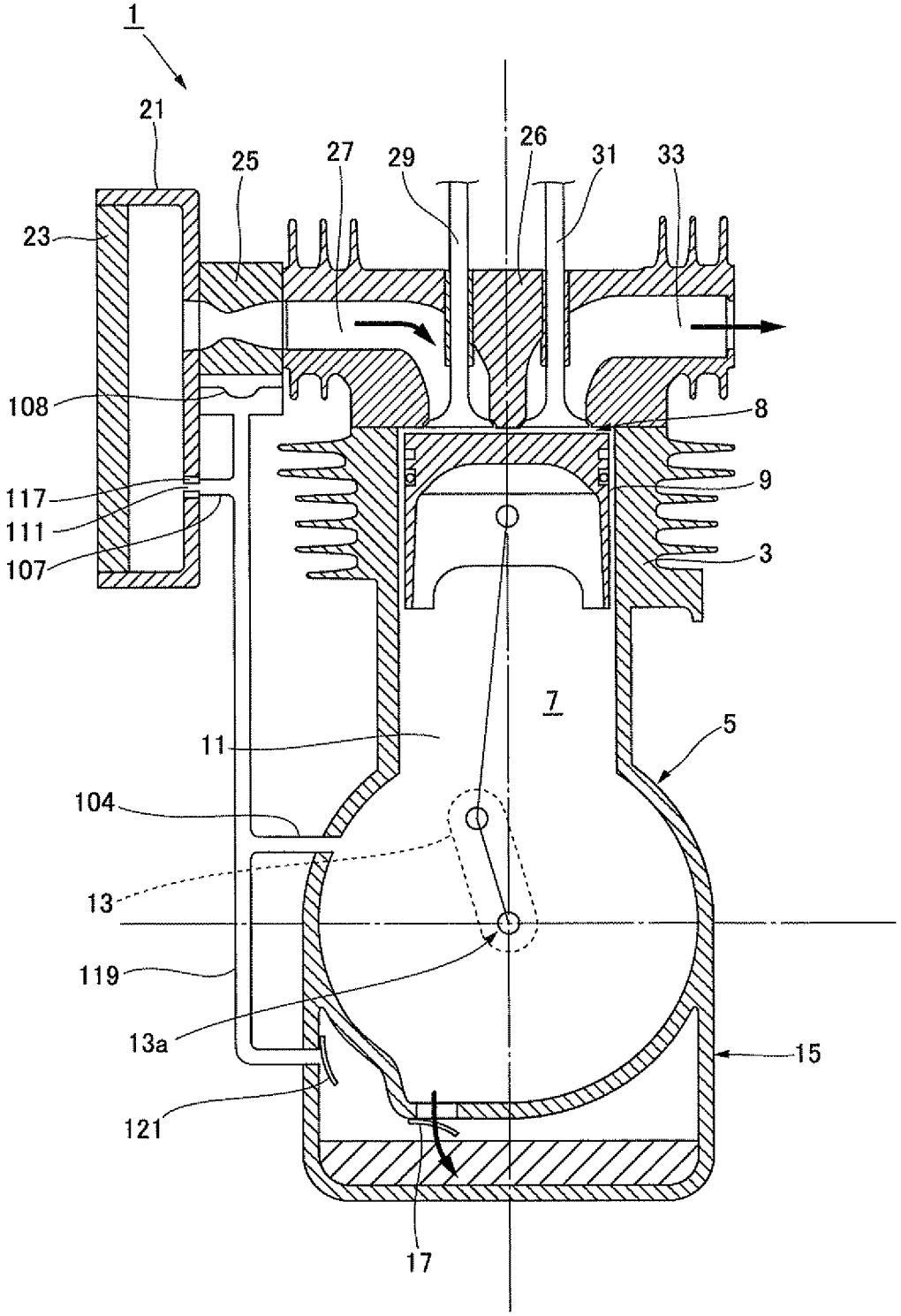
FIG. 8 is an illustration showing Embodiment 3.

FIG. 8 is an illustration showing Embodiment 3.

As shown in FIG. 8, a configuration is possible where the communicating path 104 is provided to directly communicate with the crank case 5. Moreover, in this case, a configuration is possible where the communicating path 104 branches into a second communicating path 119 to let out the positive pressure created in the communicating path 104. By this configuration, it is possible to provide a mechanism that drives the diaphragm fuel pump 109 with a simpler structure.

Moreover, it is more preferable to allow communication between the second communicating path 119 and the oil tank 15 and provide a second check valve 121 in the oil tank 15 side. Here, in this case, the elastic force of a spring and so forth used in the second check valve 121 to let out the positive pressure created in the communicating path 104 is smaller than in the check valve 17. By this configuration, it is possible to substantially provide only a negative pressure to the diaphragm fuel pump 109 with a simpler structure.

<Embodiment 4>

Figure 9:
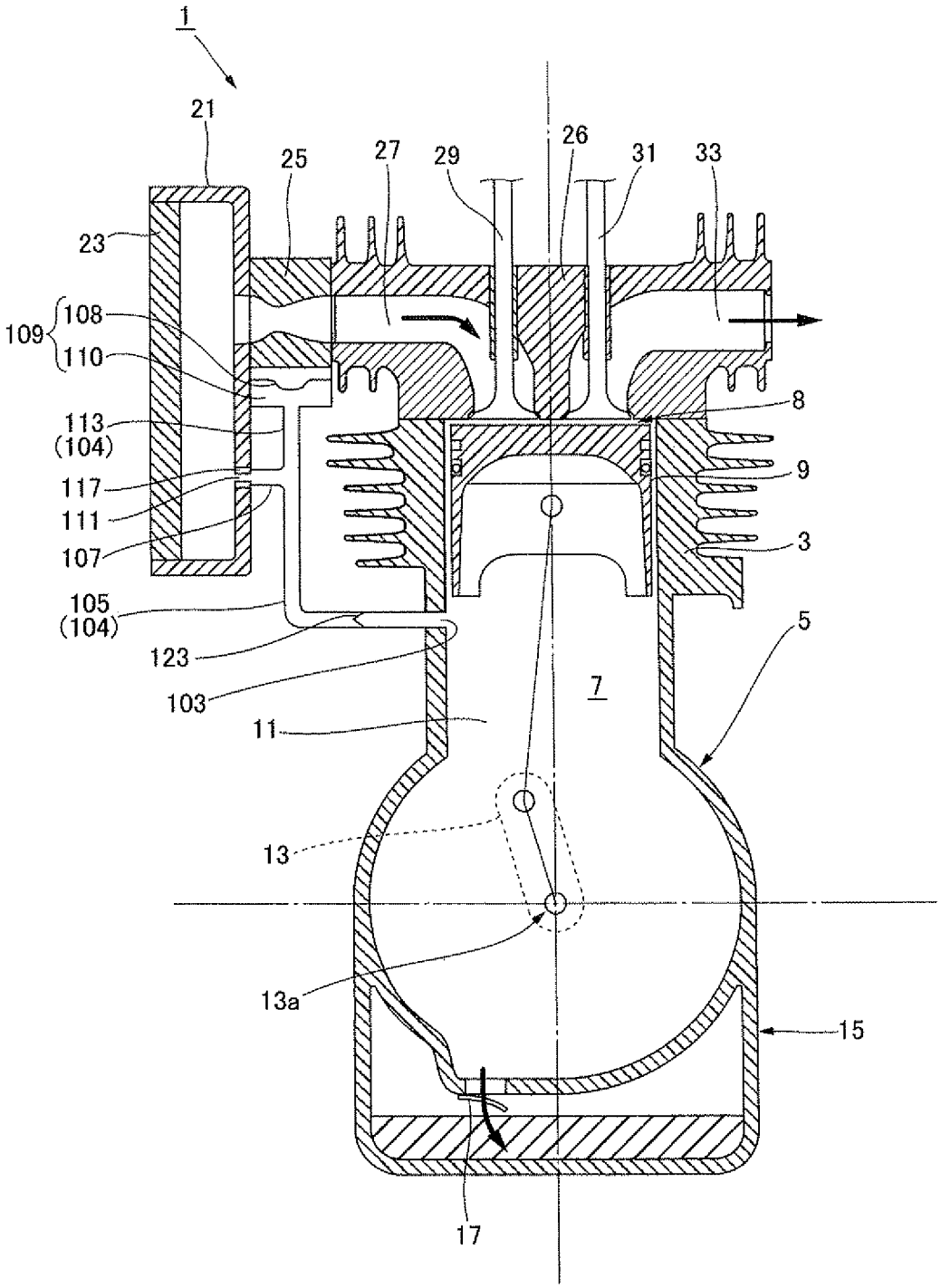
FIG. 9 is an illustration showing Embodiment 4.

FIG. 9 is an illustration showing Embodiment 4.

As shown in FIG. 9, the crank chamber side orifice 115 is not provided in the crank chamber side opening 103, but a one-way valve 123 (check valve, or lead valve) that prevents the flow from the crank chamber 7 side and permits the flow in the backward direction may be provided in the crank chamber side communicating path 105. By this configuration, it is possible to prevent oil from entering the route of the communicating path 104.

<The Configurations and Effects of the Embodiments>

The four-stroke engine 1 according to the present invention includes the crank chamber 7 in which pressure fluctuation occurs, and the carburetor 25. The carburetor 25 includes the diaphragm fuel pump 109. The diaphragm fuel pump 109 includes the pump chamber 1108 that sucks in and ejects fuel, and the diaphragm chamber 110 to which the pressure that drives the pump chamber 1108 is supplied. The diaphragm chamber 110 and the crank chamber 7 communicate with one another in a state in which a negative pressure is created in the crank chamber 7. By this configuration, it is possible to prevent oil from entering the communicating path 104 from the crank chamber 7.

The communicating path 104 is provided to allow communication between the diaphragm chamber 110 and the crank chamber 7. The atmospheric pressure opening path 107 communicating with a space under atmospheric pressure is connected to the communicating path 104. By this configuration, it is possible to prevent oil from entering the communicating path 104 with a simple mechanism. In addition, it is possible to make the pressure fluctuation in the diaphragm 110 greater.

The communicating path 104 is provided to allow communication between the diaphragm chamber 110 and the crank chamber 7. The atmospheric pressure opening path 107 that allows communication with a space under atmospheric pressure, is connected to the diaphragm 110. By this configuration, even if oil and so forth enter the diaphragm chamber 110, it is possible to eject the oil and so forth from diaphragm 110 and the communicating path 104 . In addition, it is possible to make the pressure fluctuation occurs in the diaphragm chamber 110 greater.

The communicating path 104 is provided to allow communication between the diaphragm chamber 110 and the crank chamber 7. The crank chamber side opening 103 of the communicating path 104 in the crank chamber 7 side is formed near the position in which the termination portion 9*c* of the skirt part 9*b* in the piston 9 is located when the piston 9 is located at TDC. By forming the crank chamber side opening 103 in this position, a positive pressure is not applied to the communicating path 104, and therefore it is possible to prevent oil from entering the communication path 104 from the crank chamber 7.

The communicating path 104 is provided to allow communication between the diaphragm chamber 110 and the crank chamber 7. The crank chamber side opening 103 of the communicating path 104 in the crank chamber 7 side is formed in the position closer to the crankshaft 13*a* than the position in which the piston ring 52 is located when the piston 9 is located at BDC. By forming the crank chamber side opening 103 in this position, the movement trajectory of the piston ring 52 does not overlap the crank chamber side opening 103, and therefore, it is possible to prevent the oil wiped with the piston 9 from entering the communicating path 104.

The crank chamber side opening 103 of the communicating path 104 in the crank chamber 7 side is formed in the position near the position in which the piston ring 52 of the piston 9 is located when the piston 9 is located at BDC. By this configuration, it is possible to reduce the size of the piston 9 and prevent oil and so forth from entering the communicating path 104.

The communicating path 104 is provided to allow communication between the diaphragm chamber 110 and the crank chamber 7. The crank chamber side orifice 115 is formed in the crank chamber side opening 103 of the communicating path 104 in the crank chamber 7 side. By this configuration, it is possible to prevent oil and so forth from entering the communicating path 104 from the crank chamber 7.

The communicating path 104 is provided to allow communication between the diaphragm chamber 110 and the crank chamber 7. The air cleaner side orifice 111 is formed in the atmospheric pressure opening path 107 that is connected to one of the communicating path 104 and the diaphragm chamber 110 to allow communication with a space under atmospheric pressure. By this configuration, it is possible to adequately control the pressure fluctuation in the diaphragm chamber 110. That is, with this air cleaner side orifice 111, it is possible to adequately control the timing the pressure in the diaphragm chamber 110, which is a negative pressure, returns to atmospheric pressure.

The communicating path 104 is provided to allow communication between the diaphragm chamber 110 and the crank chamber 7. The atmospheric pressure opening path 107 is connected to one of the communicating path 104 and the diaphragm chamber 110 to allow communication with a space under atmospheric pressure. The atmospheric pressure chamber opening path 107 opens in the cleaned side of the air cleaner 21. By this configuration, it is possible to prevent dust from entering the pipeline of the atmospheric pressure opening path 107. The engine according to the embodiments is applicable to a working machine such as a chain saw and a concrete cutter which generate a dust storm.

Although the four-stroke engine has been described as an example, it is possible to provide the same effect with a two-stroke engine.

In addition, the present invention is not limited to the above-described embodiments, but may have various modified structures and configurations.

The invention claimed is:

1. An engine having a structure of a four-stroke engine, the engine comprising:

a piston configured to reciprocally move;

a crank chamber in which pressure fluctuation occurs by the piston moving reciprocally in the crank chamber;

a carburetor including a diaphragm fuel pump, the diaphragm fuel pump including:

a pump chamber configured to suck in and eject fuel; and a diaphragm chamber to which a pressure that drives the pump chamber is supplied;

a single communicating path configured to allow communication between the diaphragm chamber and the crank chamber; and an opening of the communicating path in the crank chamber side, the opening being formed near a position in which a termination portion of a skirt part of the piston is located when the piston is located at a top dead center such that the piston opens and closes the opening, wherein the piston closes the opening of the communicating path when a positive pressure is created in the crank chamber and opens the opening to supply substantially only a negative pressure from the crank chamber to the diaphragm chamber via the communicating path, and the opening is not open in a combustion chamber formed by a cylinder part and an upper portion of the piston.

2. The engine according to claim 1, wherein an atmospheric pressure opening path configured to communicate with a space under atmospheric pressure is connected to the communicating path.

3. The engine according to claim 1, wherein an atmospheric pressure opening path configured to communicate with a space under atmospheric pressure is connected to the diaphragm chamber.

4. The engine according to claim 1, wherein the opening of the communicating path in the crank chamber side is formed in a position closer to a crankshaft than a position in which a piston ring is located when the piston is located at a bottom dead center.

5. The engine according to claim 4, wherein the opening of the communicating path in the crank chamber side is formed in a position near the position in which the piston ring of the piston is located when the piston is located at the bottom dead center.

6. The engine according to claim 1, further comprising a communicating path configured to allow communication between the diaphragm chamber and the crank chamber, wherein an orifice is formed in an opening of the communicating path in the crank chamber side.

7. The engine according to claim 1, further comprising a communicating path configured to allow communication between the diaphragm chamber and the crank chamber, wherein an orifice is formed in an atmospheric pressure opening path, the atmospheric pressure opening path being connected to one of the communicating path and the diaphragm chamber to allow communication with a space under atmospheric pressure.

8. The engine according to claim 1, further comprising a communicating path configured to allow communication between the diaphragm chamber and the crank chamber, wherein an atmospheric pressure opening path opens in a cleaned side of an air cleaner, the atmospheric pressure opening path being connected to one of the communicating path and the diaphragm chamber to allow communication with a space under atmospheric pressure.

9. The engine according to claim 1, wherein the opening of the communicating path in the crank chamber side is closed by the piston when a positive pressure is created in the crank chamber.

* * * * *